US007682485B2

(12) United States Patent
Barla

(10) Patent No.: US 7,682,485 B2
(45) Date of Patent: Mar. 23, 2010

(54) PAPERMAKING PROCESS

(75) Inventor: Pavol Barla, Gothenburg (SE)

(73) Assignee: Akzo Nobel N.V., Arnhem (NL)

( * ) Notice: Subject to any disclaimer, the term of this patent is extended or adjusted under 35 U.S.C. 154(b) by 368 days.

(21) Appl. No.: 11/638,109

(22) Filed: Dec. 13, 2006

(65) Prior Publication Data

US 2007/0131369 A1 Jun. 14, 2007

Related U.S. Application Data

(60) Provisional application No. 60/750,174, filed on Dec. 14, 2005.

(51) Int. Cl.
*D21F 11/00* (2006.01)

(52) U.S. Cl. ..... 162/135; 162/158; 162/164.1; 162/175; 162/178

(58) Field of Classification Search ..... 162/135, 162/158, 164.1, 164.6, 175, 178, 181.6, 184
See application file for complete search history.

(56) References Cited

U.S. PATENT DOCUMENTS

| | | | | |
|---|---|---|---|---|
| 2,630,410 | A | 3/1953 | Clapsadle et al. | 252/313 |
| 5,368,833 | A | 11/1994 | Johansson et al. | 423/338 |
| 2002/0155281 | A1 * | 10/2002 | Lang et al. | 428/337 |

FOREIGN PATENT DOCUMENTS

| | | | |
|---|---|---|---|
| EP | 0 276 200 | A1 | 7/1988 |
| EP | 0 276 952 | B1 | 8/1988 |
| EP | 0 304 952 | B1 | 3/1989 |
| JP | 2003-251928 | A | 9/2003 |
| WO | WO 88/06659 | A1 | 9/1988 |
| WO | WO 91/05108 | | 4/1991 |
| WO | WO 02/12626 | A1 | 2/2002 |

OTHER PUBLICATIONS

European Search Report for Application No. EP 05 11 2137 dated Aug. 24, 2006.
Iler, Ralph K., "The Chemistry of Silica," John Wiley & Sons (1979) pp. 407-409.
Scandinavian Pulp, Paper and Board Testing Committee, SCAN-M2:64, "Disintegration of Mechanical Pulp for Testing," (Mar. 1964) pp. 1-2.
Scandinavian Pulp, Paper and Board Testing Committee, SCAN-P 62:88, "Water absorption rate and water absorbency," (1988) pp. 1-4.
Office Action issued by the European Patent Office on Oct. 19, 2009 relating to U.S. Appl. No. 11/638,109.
Abstract of JP 2003-251928 A from Questel QPAT.

* cited by examiner

*Primary Examiner*—Mark Halpern
(74) *Attorney, Agent, or Firm*—Robert C. Morriss

(57) ABSTRACT

The present invention relates to a process for improving the absorption rate for paper products. The process comprises treating a cellulosic fiber web comprising applying to said cellulosic fiber web at least one polymer; and colloidal particles.

11 Claims, No Drawings

PAPERMAKING PROCESS

The invention relates to a papermaking process for improving the absorption rate of especially tissue and fluff products. The invention particularly relates to a papermaking process comprising applying at least one polymer and colloidal particles to a cellulosic fibre web.

BACKGROUND

Tissue paper and methods for making such paper are well known in the art. Such paper is typically made by draining a cellulosic suspension and forming a web on a wire. The cellulosic suspension is usually contained in the headbox before being deposited as a thin layer on a Fourdrinier wire to form a paper web. The paper web is then typically dewatered by vacuum dewatering and further dewatered by pressing operations wherein the web is subjected to pressure developed by opposing mechanical members, for example cylindrical rolls or an extended nip press. The dewatered web is then further pressed and dried by a steam drum apparatus known in the art as a Yankee cylinder. Fluff pulp is typically made by forming a pulp sheet on a Fourdrinier wire which is subsequently pressed and dried to form bales or rolls.

The dry pulp is then defiberized using a hammer mill or a pin defiberizer to form fluff. Typical products made from fluff are diapers and feminine hygiene products. Fluff can also be used to produce air-laid paper products.

The absorption rate is one of the most essential properties for products made from tissue and fluff such as diapers, sanitary napkins, paper towels, facial and toilet tissues etc.

The rate of absorption is dependent both on the fibre surface chemistry and on the sheet structure.

WO 91/05108 describes a process for increasing the absorption rate of fluff pulp by increasing the specific surface area of the fibres. This is done by applying a porous layer of hydrophilic chemicals which are precipitated on the fibres.

It is an object of the invention to provide a process which increases the absorption rate of paper products, especially tissue and fluff products.

It is also an object of the invention to provide a process which increases the absorption rate without decreasing the wet strength of the produced tissue and fluff products.

It is also an object of the invention to provide a process where the added components are easy to handle and can be supplied in high concentrations.

It is also an object of the invention to provide a process which reduces the problem of dusting.

THE INVENTION

The present invention relates to a process for treating a cellulosic fibre web comprising applying to said cellulosic fibre web (i) at least one polymer; and (ii) colloidal particles.

It has been found that the process of the present invention imparts increased absorption rate to the produced paper.

According to one embodiment, natural and/or synthetic polymers can be used. Suitable polymers can be cationic, anionic, amphoteric, or non-ionic in nature. The polymer can have a molecular weight of from about 2,000 to about 500,000,000, for example from about 100,000 to about 100,000,000, or from about 200,000 to about 50,000,000.

Suitably, the synthetic polymers can have a molecular weight of from about 2,000 to about 50,000,000, for example from about 100,000 to about 10,000,000, or from about 200,000 to about 1,000,000.

According to one embodiment, a cationic polymer is used. Examples of suitable cationic polymers include cationic polysaccharides, e.g. starches, guar gums, cellulose derivatives, chitins, chitosans, glycans, galactans, glucans, xanthan gums, pectins, mannans, dextrins. Suitable starches include potato, corn, wheat, tapioca, rice, waxy maize, and barley. Cationic synthetic organic polymers such as cationic chain-growth polymers may also be used, e.g. cationic vinyl addition polymers like acrylate-, acrylamide-, vinylamine-, vinylamide- and allylamine-based polymers, for example homo- and copolymers based on diallyldialkyl ammonium halide, e.g. diallyldimethyl ammonium chloride, as well as (meth) acrylamides and (meth)acrylates. Further polymers include cationic step-growth polymers, e.g. cationic polyamidoamines, polyethylene imines, polyamines such as dimethylamine-epichlorhydrin copolymers; and polyurethanes. Further examples of suitable cationic organic polymers include those disclosed in WO 02/12626. According to one embodiment, the cationic polymer is selected from the group consisting of a starch, guar gum, polydiallyldimethyl ammonium chloride, polyamidoamine, and mixtures thereof.

According to one embodiment, an anionic polymer is used. Examples of anionic polymers include anionic step-growth polymers, chain-growth polymers, polysaccharides, naturally occurring aromatic polymers and modifications thereof. Examples of suitable anionic step-growth polymers include anionic benzene-based and naphthalene-based condensation polymers, preferably naphthalene-sulphonic acid based condensation polymers and naphthalene-sulphonate based condensation polymers; and addition polymers, i.e. polymers obtained by step-growth addition polymerization, e.g. anionic polyurethanes. Examples of suitable anionic chain-growth polymers include anionic vinyl addition polymers, e.g. acrylate- and acrylamide-based polymers comprising anionic or potentially anionic monomers like (meth)acrylic acid and polystyrenesulphonic acid. Examples of suitable naturally occurring aromatic polymers and modifications thereof, i.e. modified naturally occurring aromatic anionic polymers include lignin-based polymers, preferably sulphonated lignins, e.g. lignosulphonates, kraft lignin, sulphonated kraft lignin, and tannin extracts. Further examples of other suitable anionic organic polymers include those disclosed in WO 02/12626.

The term "step-growth polymer", as used herein, refers to a polymer obtained by step-growth polymerization, also being referred to as step-reaction polymer and step-reaction polymerization, respectively. The term "chain-growth polymer", as used herein, refers to a polymer obtained by chain-growth polymerization, also being referred to as chain reaction polymer and chain reaction polymerization, respectively.

Colloidal particles that can be used include e.g. inorganic colloidal compounds of silica and metal oxides such as alumina, zirconia, magnesium oxide, titanium dioxide, iron oxide, zinc oxide; colloidal organic compounds, e.g. anionic or cationic cross-linked polyacrylamide; and combinations thereof.

According to one embodiment, the colloidal particles have an average particle diameter ranging from about 1 to about 1000, such as from about 2 to about 100, or from about 3 to about 40 nm.

According to one embodiment, the colloidal particles are colloidal silica particles.

The colloidal silica particles, which also are referred to as silica sols, may be produced from e.g. precipitated silica, pyrogenic silica (fumed silica) or silica gels with sufficient purity, and mixtures thereof. However, conventionally used sodium silicate may also be used.

Colloidal silica particles that can be used according to the invention may be modified and can contain other elements such as amines, aluminium and/or boron, which can be present in the particles and/or the continuous phase. Boron-modified silica sols are described in e.g. U.S. Pat. No. 2,630,410. The aluminium modified silica particles suitably have an $Al_2O_3$ content of from about 0.05 to about 3 wt %, such as from about 0.1 to about 2 wt %. The procedure of preparing an aluminium modified silica sol is further described in e.g. "The Chemistry of Silica", by Iler, K. Ralph, pages 407-409, John Wiley & Sons (1979) and in U.S. Pat. No. 5,368,833. According to one embodiment, the colloidal silica particles are anionic colloidal silica particles.

According to one embodiment, the colloidal silica particles have an average particle diameter ranging from about 1 to about 100, such as from about 2 to about 50, or from about 3 to about 20 nm. According to one embodiment, the colloidal silica particles have a specific surface area from about 20 to about 2700, such as from about 50 to about 1300, or such as from about 130 to about 900, or from about 400 to about 900 $m^2/g$.

As conventional in silica chemistry, particle size (diameter) refers to average size (diameter) of primary particles which may be aggregated or non-aggregated.

According to one embodiment, cationic colloidal particles are used. According to one embodiment, a cationic polymer, an anionic polymer and cationic colloidal particles are applied in the mentioned order.

According to one embodiment, a cationic polymer is firstly applied whereafter anionic colloidal particles are applied.

The term "cellulosic fibre web" as used herein, includes any sheet or web prepared from cellulosic fibres such as pulp sheets or paper webs.

When making fluff, the polymer and the colloidal particles can be applied to the pulp sheet prior to defiberization. The polymer and the colloidal particles can be applied before or after drying of a cellulosic fibre web, e.g. during any stage in a converting machine for the production of a tissue product. The cellulosic fibre web can have varying dry content when polymer and colloidal particles are applied. According to one embodiment, the cellulosic fibre web has a dry content of from about 5 to about 95, such as from about 30 to about 60, or from about 30 to about 50 wt %.

According to one embodiment, the polymer can be applied by immersion of the cellulosic fibre web into a solution or dispersion of the polymer.

According to one embodiment, the colloidal particles can be applied by immersion of the cellulosic fibre web into a dispersion comprising the colloidal particles.

According to one embodiment, the polymer can be applied by spraying the polymer dispersion on the surface of the cellulosic fibre web. Suitable polymer concentrations of the solution or dispersion depend on the viscosity of polymer solution or dispersion. The viscosity is dependent on inter alia the type and molecular weight of the polymer. However, suitable concentrations may be from about 0.001 to about 30, for example from about 0.01 to about 10, or from about 0.1 to about 5 wt %.

According to one embodiment, the polymer and the colloidal particles are applied by spraying.

According to one embodiment, the colloidal particles can be applied by spraying after the polymer has been applied. The dispersion of colloidal particles can have a dry content of from about 0.001 to about 60, such as from about 0.05 to about 10, or from about 0.1 to about 5 wt %.

The polymer can be applied in an amount of from about 0.01 to about 35, such as from about 0.1 to about 15, or from about 0.5 to about 7 kg/ton dry cellulosic fibres.

The colloidal particles can be applied in an amount of from about 0.01 to about 35, such as from about 0.1 to about 15, or from about 0.5 to about 7 kg/ton dry cellulosic fibres.

The weight ratio of applied polymer to applied colloidal particles can be from about 1:50 to about 50:1, such as from about 1:5 to about 5:1, or from about 0.8:1 to about 1:0.8.

According to one embodiment, the polymer and the colloidal particles can be applied to the cellulosic fibre web simultaneously, e.g. as a pre-blend or simultaneously at the same addition point in the process.

According to one embodiment, the polymer and the colloidal particles can be applied to the cellulosic fibre web separately.

According to one embodiment, the polymer is firstly applied to the cellulosic fibre web followed by application of the colloidal particles.

The surface of the cellulosic fibre web is usually negatively charged. In order to effectively deposit negatively charged particles like anionic colloidal silica particles, the surface of the fibres can be made cationically charged. This can be made by applying a cationic polymer prior to the addition of anionic colloidal particles. According to one embodiment, a cationic polymer is applied on the web whereupon an anionic polymer subsequently is added prior to applying cationic colloidal particles.

Cellulosic fibre webs may include cellulosic fibres derived from wood pulp e.g. softwood and hardwood pulp including chemical pulp such as Kraft, sulphite and sulphate pulps, as well as mechanical pulps such as ground wood, thermomechanical pulp and chemical modified thermomechanical pulp (CTMP). Recycled fibres may also be used. Mixtures of chemical pulp and mechanical pulp may also be used. Furthermore, in the produced tissue or fluff products other cellulosic fibres, such as rayon or cotton, can be comprised as well as synthetic fibres. The tissue or fluff products can also comprise different superabsorbent materials.

According to one embodiment, conventional additives may be added to the cellulosic suspension used to produce the cellulosic fibre web which in turn is processed to provide fluff or tissue products. Such additives include e.g. wet strength agents, dry strength agents, wetting agents and debonding agents.

The invention is further illustrated by the following examples but the invention is not intended to be limited thereby.

EXAMPLE 1

The stock was prepared according to the standard method SCAN-M2:64. The number of revolutions made by the disintegrator propeller was 30000 and the concentration of the fibre suspension was 2.2 wt %, CSF=700 ml. Laboratory sheets (w=90 $g/m^2$) were made in a Dynamic Sheet Former from a stock of 0.5 wt % HTCTMP (high temperature chemithermomechanical pulp) without any addition of chemicals.

The sheet was cut into rectangular pieces (160×50 mm) with the longer side parallel to the cross direction. The test paper pieces were treated at ambient temperature by immersion in a polymer solution, referred to as a polyelectrolyte solution in the working examples herein (cationic, anionic or both solutions), and/or a silica sol dispersion. An untreated reference sample was treated with tap water. The concentrations of polyelectrolyte (polymer) and colloidal silica in the respective dispersions were 0.1 wt %. The immersion time was 1 min in each of the dispersions.

After immersion in the cationic polyelectrolyte dispersion, the test pieces were placed between two sheets of blotting paper and couched by rolling a metallic cylinder (w=10.6 kg, L=210 mm, d=85 mm) back and forth. Then after subsequent immersion in silica sol, the samples treated according to the invention were couched again in the same way. The untreated sample (mentioned reference herein), a sample treated with only polymer, and a sample treated with only silica sol were couched in the same way. The paper samples placed on a perforated stainless plate and were stretched by fixing their ends with paper tape or metallic strips and clips. The plates with the samples were placed in a drying box for drying (110° C./60 min). Prior to testing the absorption rate the samples were stored overnight in a conditioning room (23° C./50% RH).

The polymers, P1-P4, and the silica particles, A1-A4, used in the examples are listed below:

| | | |
|---|---|---|
| P1: | Polydadmac | Eka ATC 6140 |
| P2: | C-Starch | PB 930, D.S. 0.04 |
| P3: | Guar Gum | Maypro-Bond, D.S. 0.05 |
| P4: | Polyamideamine | Kenores XO |
| A1: | Silica sol | BMA 0 (500 $m^2/g$) |
| A2: | Silica sol | Bindzil 50/80 (80 $m^2/g$) |
| A3: | Silica sol | HDK N20 (200 $m^2/g$) |
| A4: | Silica sol | NP590 (850 $m^2/g$) |

The measurement of the water absorption rate was performed according to the standard method SCAN-P 62:88. The absorption rate is determined in all three principal directions, i.e. the machine direction, the cross direction, and the direction perpendicular to the plane of the sheet. The reported values are average values of three measurements.

EXAMPLE 2

Polymer P1 and colloidal particles A1 were used in example 2, which was performed as described in example 1. Measurements were performed on untreated paper (reference), paper treated with only polymer P1, as well as paper treated with both polymer P1 and colloidal particles A1. The absorption rate in mm/s was measured in the x, y and z directions. The results are given in table 1.

TABLE 1

| | Direction | | |
|---|---|---|---|
| | x | y | z |
| Reference | 1.42 | 4.07 | 1.06 |
| P1 | 0.74 | 1.86 | 0.38 |
| P1 + A1 | 4.95 | 10.71 | 8.27 |

In table 1, it can clearly be seen that the absorption rate is significantly improved when both polymer P1 and colloidal particles A1 according to the present invention are applied to the sheet compared to the untreated sheet (reference) or the sheet treated with only polymer P1.

EXAMPLE 3

Polymer P4 and colloidal particles A1 were used in example 3, which was performed as described in example 1. Measurements were performed on untreated paper (reference), paper treated with only polymer P4, paper treated with only colloidal particles A1, as well as paper treated with both polymer P4 and colloidal particles A1. The absorption rate in mm/s was measured in the x, y and z directions. The results are given in table 2.

TABLE 2

| | Direction | | |
|---|---|---|---|
| | x | y | z |
| Reference | 1.23 | 3.25 | 0.89 |
| P4 | 0.62 | 1.61 | 0.22 |
| A1 | 1.71 | 4.48 | 1.4 |
| P4 + A1 | 3.27 | 6.3 | 3.4 |

In table 2, it can clearly be seen that the absorption rate is significantly improved when both polymer P4 and colloidal particles A1 according to the present invention are applied to the sheet compared to the reference sheet or the sheets treated with only polymer or only colloidal particles.

EXAMPLE 4

Polymer P2 and colloidal particles A1 were used in example 4, which was performed as described in example 1. Measurements were performed on untreated paper (reference) and on paper treated with only polymer P2, paper treated with only colloidal particles A1, as well as paper treated with both polymer P2 and colloidal particles A1. The absorption rate in mm/s was measured in the x, y and z directions. The results are given in table 3.

TABLE 3

| | Direction | | |
|---|---|---|---|
| | x | y | z |
| Reference | 1.48 | 3.83 | 1.18 |
| P2 | 3.67 | 8.74 | 4.54 |
| A1 | 1.81 | 4.57 | 1.43 |
| P2 + A1 | 5.66 | 11.48 | 9.08 |

In table 3, it can clearly be seen that the absorption rate is significantly improved when both polymer P2 and colloidal particles A1 according to the present invention are applied to the sheet compared to the reference sheet or the sheet treated with only polymer or only colloidal particles.

EXAMPLE 5

Polymer P3 and colloidal particles A1 were used in example 5, which was performed as described in example 1. Measurements were performed on untreated paper (reference), on paper treated with only polymer P3, paper treated with only colloidal particles A1, as well as paper treated with both polymer P3 and colloidal particles A1. The absorption rate in mm/s was measured in the x, y and z directions. In trials 3 and 5, the samples were treated with polyelectrolyte and silica sol dispersion in accordance with example 1. In addition, after each immersion and couch stage, the samples were rinsed by immersion in deionized water for 1 min followed by couching. The results are given in table 4.

TABLE 4

| Trial No. | | Direction x | y | z |
|---|---|---|---|---|
| 1 | Reference | 1.67 | 4.17 | 1.15 |
| 2 | P3 | 2.7 | 5.45 | 2.4 |
| 3 | P3 (rinsed) | 2.88 | 5.2 | 2.6 |
| 4 | P3 + A1 | 6.6 | 14.5 | 12 |
| 5 | P3 (rinsed) + A1 (rinsed) | 6.98 | 13.4 | 15.8 |

In table 4, it can clearly be seen that the absorption rate is significantly improved when both polymer P3 and colloidal particles A1 according to the present invention are applied to the sheet compared to the reference or the sheets treated with only polymer or only colloidal particles. The improvement can be seen both with and without rinsing the sheets after treatment.

EXAMPLE 6

Polymer P1 and colloidal particles A1-A4 were used in example 6, which was performed as described in example 1. Measurements were performed on untreated paper (reference) and on paper treated with only polymer P1, as well as paper treated with both polymer P1 and colloidal particles A1-A4. The absorption rate in mm/s was measured in the x, y and z directions. The results are given in table 5.

TABLE 5

| | Direction x | y | z |
|---|---|---|---|
| Reference | 1.63 | 3.98 | 1.6 |
| P1 + A1 | 5.92 | 11.7 | 10.4 |
| P1 + A2 | 3.27 | 6.2 | 5.2 |
| P1 + A3 | 2.76 | 6.38 | 6.4 |
| P1 + A4 | 5.11 | 11.1 | 17.1 |

In table 5, it can clearly be seen that the absorption rate is improved when colloidal particles having a large specific surface area, A1 and A4, are applied to the sheet compared to colloidal particles having a smaller specific surface area, A2 and A3.

The invention claimed is:

1. A process for treating a cellulosic fibre web comprising applying to said cellulosic fibre web (i) at least one polymer; and (ii) colloidal particles having a specific surface area of from about 130 to about 900 $m^2/g$, wherein the weight ratio of polymer to colloidal particles ranges from about 50:1 to about 1:50.

2. A process according to claim 1, wherein the colloidal particles are colloidal silica particles.

3. A process according to claim 1, wherein the colloidal particles are anionic.

4. A process according to claim 1, wherein said at least one polymer is cationic.

5. A process according to claim 1, wherein said at least one polymer is selected from starch, guar gum, polydiallyldimethyl ammonium chloride, polyamidoamine, and mixtures thereof.

6. A process according to claim 1, wherein a cationic polymer, an anionic polymer and cationic colloidal particles are applied in the mentioned order.

7. A process according to claim 1, wherein said at least one polymer is applied in an amount of from about 0.01 to about 35 kg/ton dry cellulosic fibres.

8. A process according to claim 1, wherein the colloidal particles are applied in an amount of from about 0.01 to about 35 kg/ton dry cellulosic fibres.

9. A process according to claim 1, wherein said at least one polymer and the colloidal particles are applied by spraying.

10. A process according to claim 1, wherein said at least one polymer and the colloidal particles are applied separately.

11. A process according to claim 1, wherein said at least one polymer and colloidal particles are applied simultaneously.

* * * * *